US012636544B1

(12) United States Patent
Liu et al.

(10) Patent No.: US 12,636,544 B1
(45) Date of Patent: May 26, 2026

(54) MANUALLY ADJUSTABLE LIFTING MECHANISM AND TREADMILL

(71) Applicant: Shenzhen Yile Dynamic Technology Co., LTD, Shenzhen (CN)

(72) Inventors: Ren Liu, Shenzhen (CN); Jinsong Fan, Shenzhen (CN)

(73) Assignee: Shenzhen Yile Dynamic Technology Co., LTD, Shenzhen (CN)

( * ) Notice: Subject to any disclaimer, the term of this patent is extended or adjusted under 35 U.S.C. 154(b) by 0 days.

(21) Appl. No.: 19/220,675

(22) Filed: May 28, 2025

(30) Foreign Application Priority Data

Apr. 21, 2025 (CN) ..... 202520761848.X

(51) Int. Cl.
*A63B 22/02* (2006.01)

(52) U.S. Cl.
CPC ..... *A63B 22/02* (2013.01); *A63B 2225/093* (2013.01)

(58) Field of Classification Search
CPC ..... A63B 22/02–0292; A63B 2225/093
See application file for complete search history.

(56) References Cited

U.S. PATENT DOCUMENTS

| | | | | |
|---|---|---|---|---|
| 4,776,582 | A * | 10/1988 | Ramhorst | A63B 22/0023 482/54 |
| 6,743,155 | B2 * | 6/2004 | Pan | A63B 22/0023 482/54 |
| 6,905,443 | B1 | 6/2005 | Lo | |
| 6,923,747 | B1 | 8/2005 | Chu | |
| 6,945,912 | B2 | 9/2005 | Levi | |
| 7,104,930 | B2 | 9/2006 | Lo et al. | |
| 7,141,006 | B1 | 11/2006 | Chen et al. | |
| 7,153,241 | B2 | 12/2006 | Wang | |
| 12,102,884 | B1 * | 10/2024 | Jiang | A63B 22/16 |
| 2021/0046353 | A1 * | 2/2021 | Dalebout | A63B 22/0023 |
| 2024/0399196 | A1 * | 12/2024 | Miao | A63B 22/02 |
| 2025/0082985 | A1 * | 3/2025 | Liu | A63B 22/02 |
| 2025/0186829 | A1 * | 6/2025 | Hu | A63B 22/0235 |
| 2025/0242197 | A1 * | 7/2025 | Hu | A63B 22/0046 |

* cited by examiner

*Primary Examiner* — Megan Anderson
*Assistant Examiner* — Kathleen M Fisk

(57) ABSTRACT

A lifting mechanism includes a frame and two first supporting structures disposed at the first end of the frame and two second supporting structures disposed at a second end of the frame. The second supporting structure includes a second leg, a positioning plate and a support rod, a side of the positioning plate defines a slide groove, and one side of the slide groove in its longitudinal direction defines a positioning notch. The support rod is rotatably connected to the second leg, and the support rod is provided with a positioning block, which may slide in the slide groove. A treadmill includes the above lifting mechanism and a running belt.

10 Claims, 13 Drawing Sheets

MANUALLY ADJUSTABLE LIFTING MECHANISM AND TREADMILL

CROSS REFERENCE TO RELATED APPLICATIONS

This application claims priority benefits to Chinese Patent Application No. 202520761848X, filed on Apr. 21, 2025, the contents of which are incorporated herein by reference.

TECHNICAL FIELD

The present disclosure relates to a manually adjustable lifting mechanism and a treadmill.

BACKGROUND

Traditional treadmills implement elevation adjustment functions through electric lifting motors, which incurs relatively high production and manufacturing costs. Additionally, conventional treadmills exclusively feature positive slope configurations (the front end of the running platform is elevated while the rear end remains lower, creating an uphill terrain when a user faces the equipment), resulting in relatively limited workout modes for fitness purposes.

SUMMARY

A first aspect of the present disclosure provides a manually adjustable lifting mechanism including: a frame having a first end and a second end opposite to each other in a longitudinal direction of the frame; two first supporting structures disposed at the first end of the frame, each of the two first supporting structures disposed on the frame along the longitudinal direction of the frame, each of the two first supporting structures including a first leg having a first end rotatably connected to the frame, and the first leg selectively rotated between a supporting state and a folding state; and two second supporting structures disposed at the second end of the frame, each of the two second supporting structures disposed on the frame along the longitudinal direction of the frame. Each of the two second supporting structures includes: a second leg, a first end of the second leg being rotatably connected to the frame; a positioning plate secured to the frame, and a side of the positioning plate being parallel to a rotation surface of the second leg; the side of the positioning plate defining a slide groove, and at least one side of the slide groove along a longitudinal direction of the slide groove defining at least one positioning notch; and a support rod, a first end of the support rod being rotatably connected to the first end of the second leg, a second end of the support rod being provided with a positioning block, and the positioning block configured to slide in the slide groove. The second leg is configured to selectively rotate toward a support surface and drive the positioning block to slide in the slide groove, and the positioning block is configured to selectively slide into the at least one positioning notch to lock the second leg.

A second aspect of the present disclosure provided a treadmill, including the manually adjustable lifting mechanism describe above and a running belt. The first end of the frame being provided with a first roller, the second end of the frame being provided with a second roller, and the running belt wrapping around the first roller and the second roller.

BRIEF DESCRIPTION OF THE DRAWINGS

The drawings that form part of the present disclosure are provided to further illustrate the present disclosure. The illustrative embodiments and their descriptions of the present disclosure are intended to explain but do not constitute an undue limitation on the present disclosure.

DETAILED WAY

Figure 1:
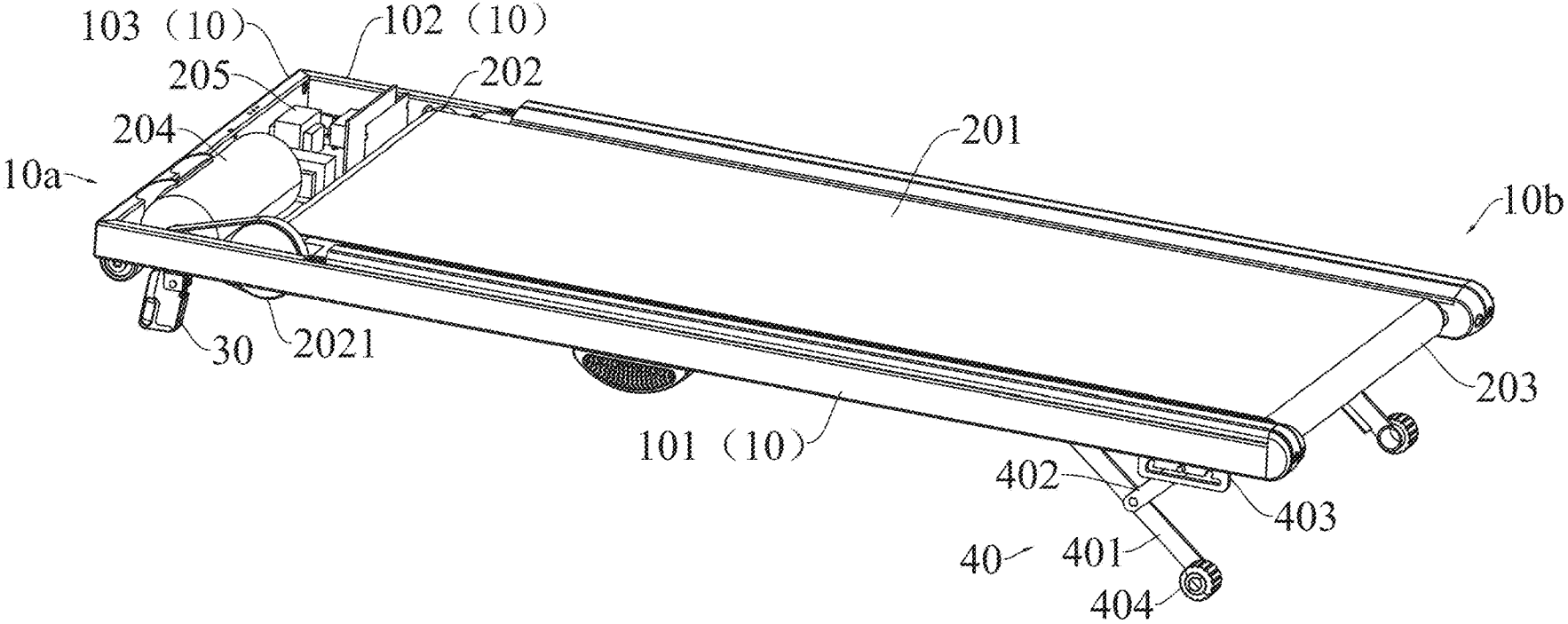
FIG. 1 is a perspective view of a treadmill according to some embodiments of the present disclosure.

The present disclosure is described in detail below with reference to the accompanying drawings and in conjunction with various embodiments. Each example is provided to explain but not to constitute undue limitation on the present disclosure. In fact, it is clear to those of ordinary skill that modifications and variations may be made without departing from the scope or spirit of the present disclosure. For example, a feature shown or described as a part of some embodiments may be used by some embodiments to produce yet some embodiments. Therefore, it is intended that the present disclosure includes such modifications and variations within the scope of the appended claims and their equivalents.

In the description of the present disclosure, the terms "longitudinal", "lateral", "upper", "lower", "front", "back", "left", "right", "vertical", "horizontal", "top", "bottom" and the like indicate the orientational or positional relationships based on the orientational or positional relationships illustrated in the drawings, which are only for the convenience of describing and do not require the present disclosure to be constructed and operated in a specific orientation, and therefore shall not be understood as limitation on the present disclosure. The terms "connected", "connecting" and "disposed" used in the present disclosure should be understood in a broad sense. For example, it may be a fixed connection or a detachable connection; it may be directly connected or indirectly connected through an intermediate component; it may also be a wired electrical connection, a radio connection, or a wireless signal connection. For those of ordinary skill in the art, the specific meanings of the above terms may be understood according to the specific circumstances.

One or more examples of the present disclosure are illustrated in the attached drawings. Characters and letters are used in the detailed description to refer to features in the drawings. Similar signs in the drawings and descriptions have been configured to refer to similar parts of the present disclosure. As used herein, the terms "first", "second" and "third" are used interchangeably to distinguish one component from another and are not intended to indicate the position or importance of each component.

As shown in FIG. 1, according to some embodiments of the present disclosure, a treadmill is provided, which includes a frame 10 and a running belt 201. A first end 10*a* of the frame 10 is provided with a first roller 202, a second end 10*b* of the frame 10 is provided with a second roller 203, and the first roller 202 and the second roller 203 are disposed opposite to each other. The frame 10 includes a first border 101 and a second border 102 that are parallel to each other. The first roller 202 and the second roller 203 are disposed between the first border 101 and the second border 102. Two ends of the first roller 202 and the second roller 203 are connected to the first border 101 and the second border 102. The running belt 201 surrounds the first roller 202 and the second roller 203. In some embodiments, the treadmill is further provided with a motor 204, and the motor 204 is disposed at the first end of the frame 10. An output end of the motor 204 is connected to a pulley 2021 of the first roller 202 through a transmission belt. The pulley 2021 is fixedly mounted at an end of the first roller 202. In addition, in some embodiments, the treadmill is also provided with a control circuit 205 for controlling a working state of the motor 204 and a working state of other electronic components on the treadmill. The specific structure of the control circuit 205 are not specifically limited here.

In some embodiments of the present disclosure, a user usually steps onto the treadmill from the second end of the frame 10. Therefore, in some embodiments of the present disclosure, when the first end 10*a* of the frame 10 is higher than the second end 10*b*, it is defined as a positive slope of the treadmill; conversely, when the first end 10*a* of the frame 10 is lower than the second end 10*b*, it is defined as a negative slope of the treadmill. In addition, in the present disclosure, the first end 10*a* and the second end 10*b* of the frame 10 are located at two ends of a longitudinal direction of the frame 10. The longitudinal direction of the frame 10 is also longitudinal directions of the treadmill, the first border 101, and the second border 102.

In some embodiments of the present disclosure, the first end 10*a* and the second end 10*b* of the frame 10 are both provided with a support structure for adjusting heights of the two ends, and the slope of the treadmill is adjusted by the support structures at the two ends.

Figure 2:
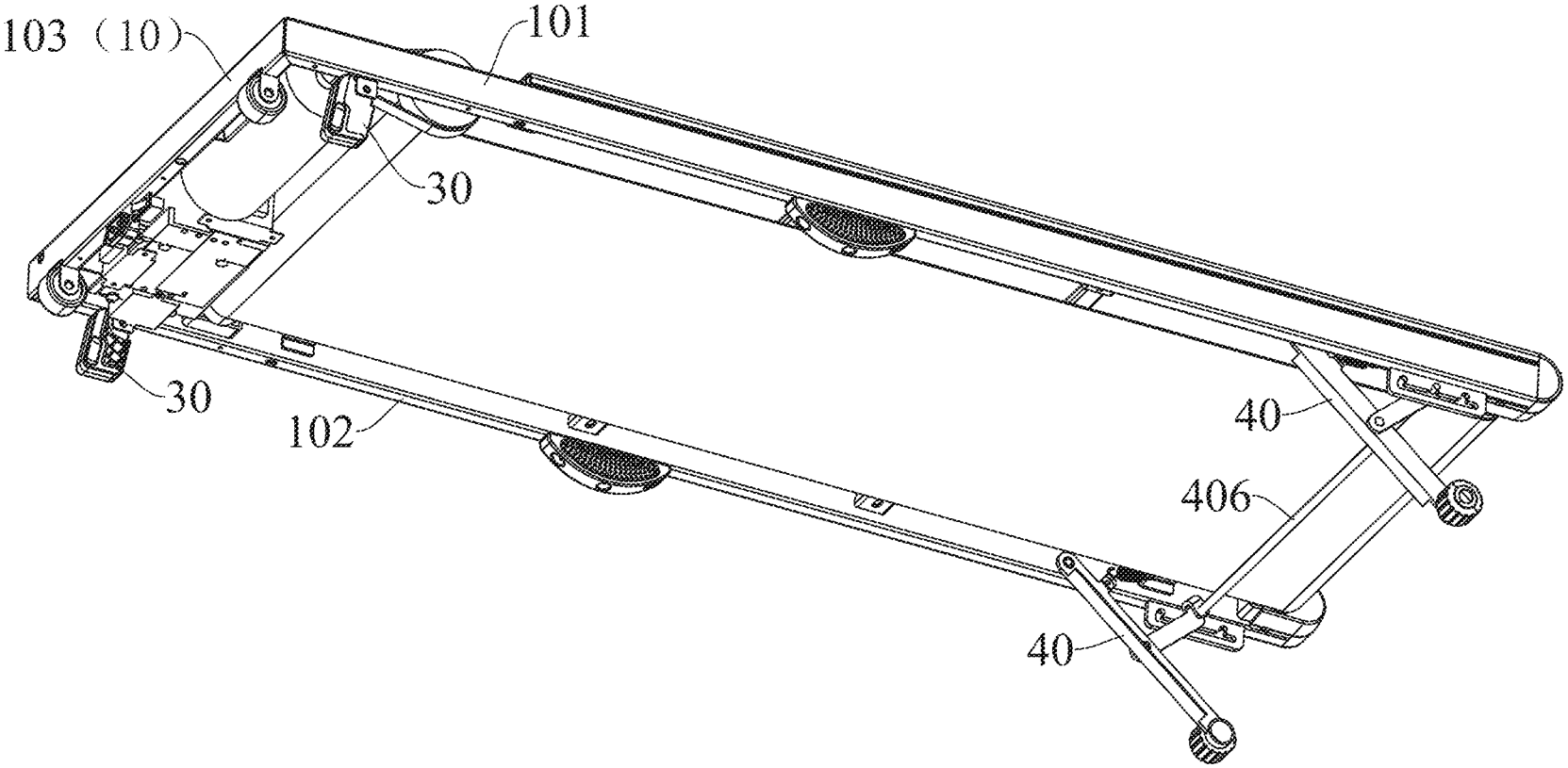
FIG. 2 is another perspective view of the treadmill according to some embodiments of the present disclosure.

As shown in FIG. 1 and FIG. 2, the first end 10*a* of the frame 10 is provided with two first support structures 30, and the two first support structures 30 are symmetrically installed on the first border 101 and the second border 102 respectively.

As shown in FIG. 1 to FIG. 5, taking the first border 101 as an example, in some embodiments, the first support structure 30 is disposed on a side of the first border 101 facing the ground. The first support structure 30 includes a first leg 301 and a support seat 302, the support seat 302 is secured to the first border 101, and the first leg 301 has a first end and a second end in opposite directions. The first end of the first leg 301 is rotatably connected to the support seat 302 at an axis. The axis is parallel to the side of the frame 10 facing the ground. The first leg 301 may be selectively rotated around the axis to allow the second end of the first leg 301 to rotate toward or away from the ground. The second end of the first leg 301 rotates toward the ground and may support the first end of the frame 10.

Figure 3:
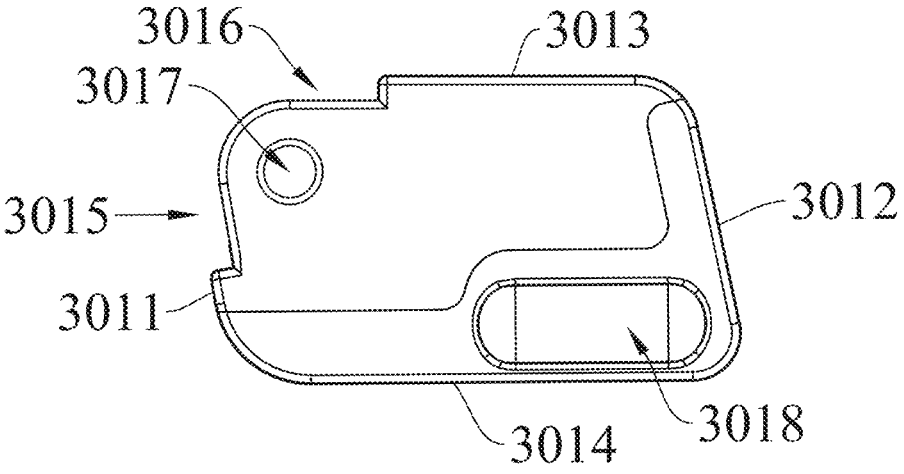
FIG. 3 is a perspective view of a first leg according to some embodiments of the present disclosure.

As shown in FIG. 3, in some embodiments, the first end of the first leg 301 has a first side surface 3011, and the second end of the first leg 301 has a second side surface 3012. The first leg 301 further has a third side surface 3013 and a fourth side surface 3014 opposite to each other. The third side surface 3013 and the fourth side surface 3014 both extend between the first side surface 3011 and the second side surface 3012. A distance between the first side surface 3011 and the second side surface 3012 is greater than a distance between the third side surface 3013 and the fourth side surface 3014. The first end of the first leg 301 defines an axial hole 3017, and a distance between the axial hole 3017 and the third side surface 3013 is smaller than a distance between the axial hole 3017 and the fourth side surface 3014. A shaft of the first support structure 30 may be inserted into and rotatably connected to the axial hole 3017. The first side surface 3011, the second side surface 3012, the third side surface 3013 and the fourth side surface 3014 are all parallel to an axis of the axial hole 3017.

Figure 4:
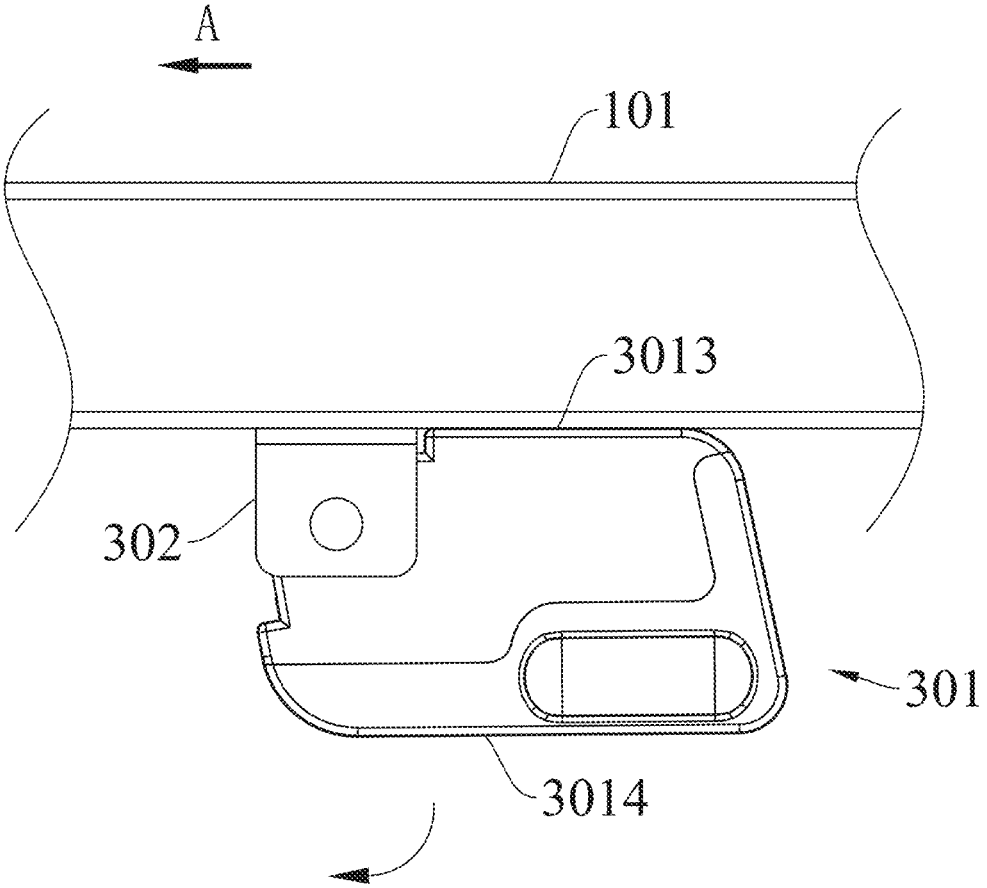
FIG. 4 is a perspective view of a first support structure being disposed below a first border and in a folded state according to some embodiments of the present disclosure.
Figure 5:
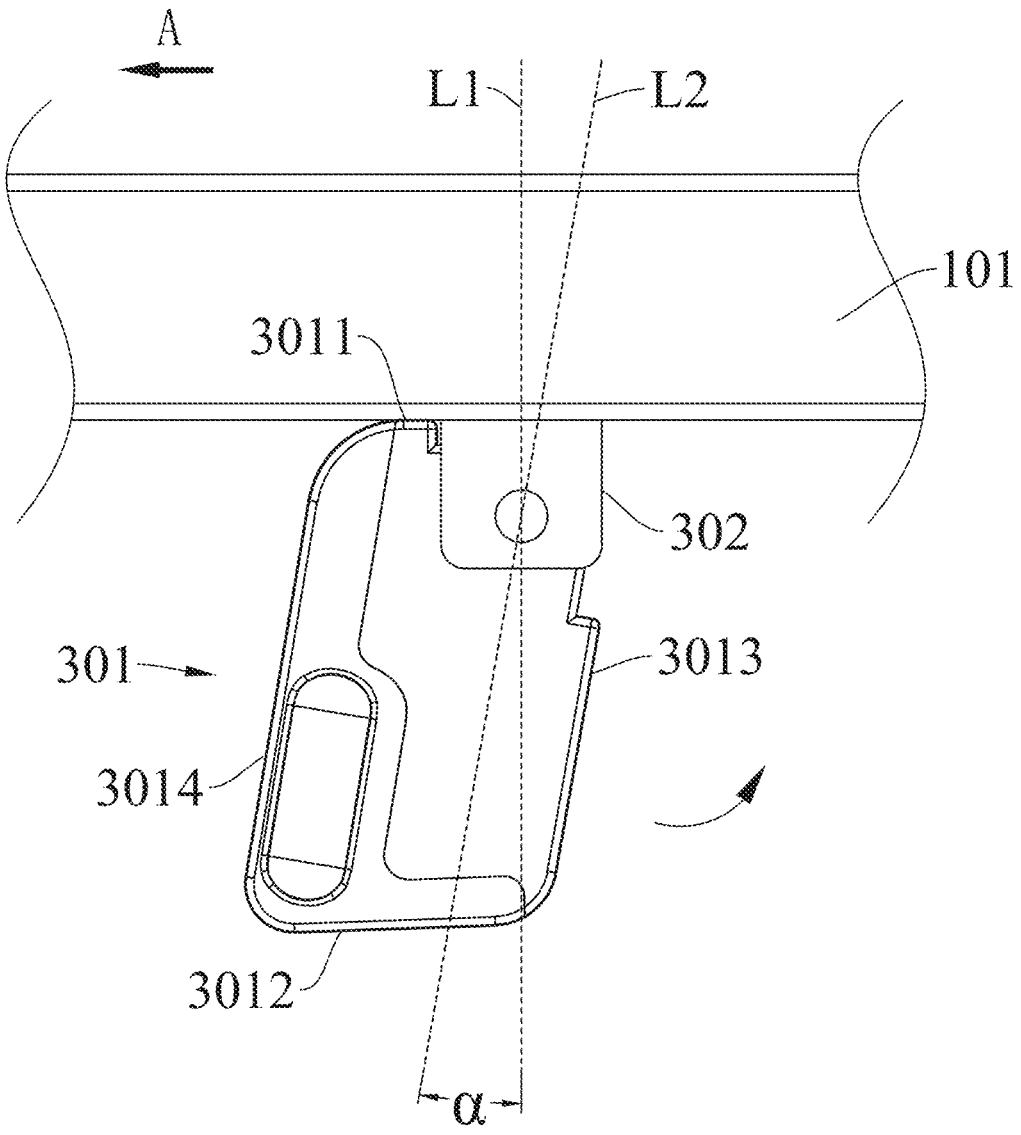
FIG. 5 is a perspective view of a first support structure being disposed below a first border and in a supporting state according to some embodiments of the present disclosure.

FIG. 4 (the direction indicated by arrow A in the drawings of the present disclosure is the first end of the frame 10) shows a folded state of the first support structure 30, in which at least a portion of the third side surface 3013 of the first leg 301 abuts against the first side of the frame 10 and the fourth side surface 3014 abuts against the ground. FIG. 5 shows a supporting state of the first support structure 30, in which at least a portion of the first side surface 3011 of the first leg 301 abuts against the first side of the frame 10, and the second side surface 3012 of the first leg 301 abuts against the ground. The first support structure 30 may be turned from the folded state to the supporting state by rotating the first leg 301 along the direction indicated by the arrow in FIG. 4. The first support structure 30 may be turned from the supporting state to the folded state by rotating the first leg 301 along the direction indicated by the arrow in FIG. 5.

As shown in FIG. 5, L1 is an auxiliary line perpendicular to the first border 101, and L2 is an auxiliary line in the longitudinal direction from the first end to the second end of the first leg 301. When the first support leg is in the supporting state, an angle between the auxiliary line L2 and the auxiliary line L1 is not 90 degrees. During the rotating process of the first support structure 30, the first support leg 301 rotates along its longitudinal direction to be perpendicular to the first border 101 and then continues to rotate at a preset angle α, allowing the first support leg 301 to be more stable in the supporting state.

Figure 6:
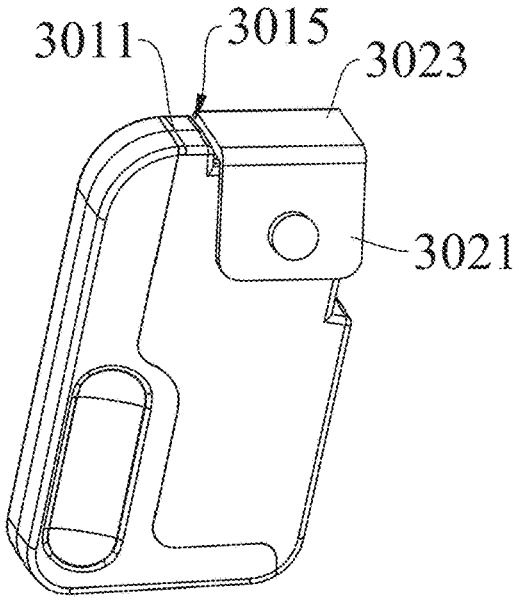
FIG. 6 is a perspective view of a first support structure being in a supporting state and a bottom of a support seat being received in a first groove according to some embodiments of the present disclosure.
Figure 7:
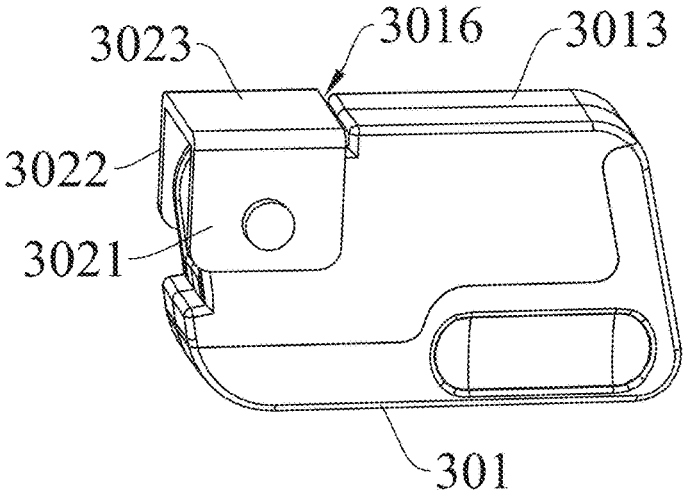
FIG. 7 is a perspective view of a first support structure being in a folded state and a support seat being received in a second groove according to some embodiments of the present disclosure.

As shown in FIG. 3, FIG. 6 and FIG. 7, the support seat 302 of the first support structure 30 includes a seat bottom 3023, and a first hinge 3021 and a second hinge 3022 disposed on the seat bottom 3023. The first end of the first support leg 301 is disposed between and rotatably connected to the first hinge 3021 and the second hinge 3022. A portion of the first side surface 3011 proximal to the third side surface 3013 defines a first groove 3015 which is inwardly concave. When the first supporting structure 30 is in the supporting state, the first groove 3015 receives at least a portion of the base 3023 to increase the contact area between the first side surface 3011 of the first leg 301 and the first border 101. A portion of the third side surface 3013 proximal to the first side surface 3011 defines a second groove 3016 which is inwardly concave. When the first supporting structure 30 is in the stored state, the second groove 3016 receives at least a portion of the base 3023 to increase the contact area between the third side surface 3013 of the first leg 301 and the first border 101.

As shown in FIG. 3, in some embodiments, the first leg 301 also includes a fifth side and a sixth side opposite to each other, and both the fifth side and the sixth side extend between the first side surface 3011, the second side surface 3012, the third side surface 3013 and the fourth side surface 3014. The fifth side and/or the sixth side define/defines an inwardly recessed clamping groove 3018. When the first support structure 30 is switched between the folded state and the supporting state, a fingertip of a user may be inserted into the clamping groove 3018 to allow the first leg 301 to have a better load-bearing point.

As shown in FIG. 1 and FIG. 2, the second end 10*b* of the frame 10 is provided with two second support structures 40, and the two second support structures 40 are symmetrically installed on the first border 101 and the second border 102 respectively.

Figure 8:
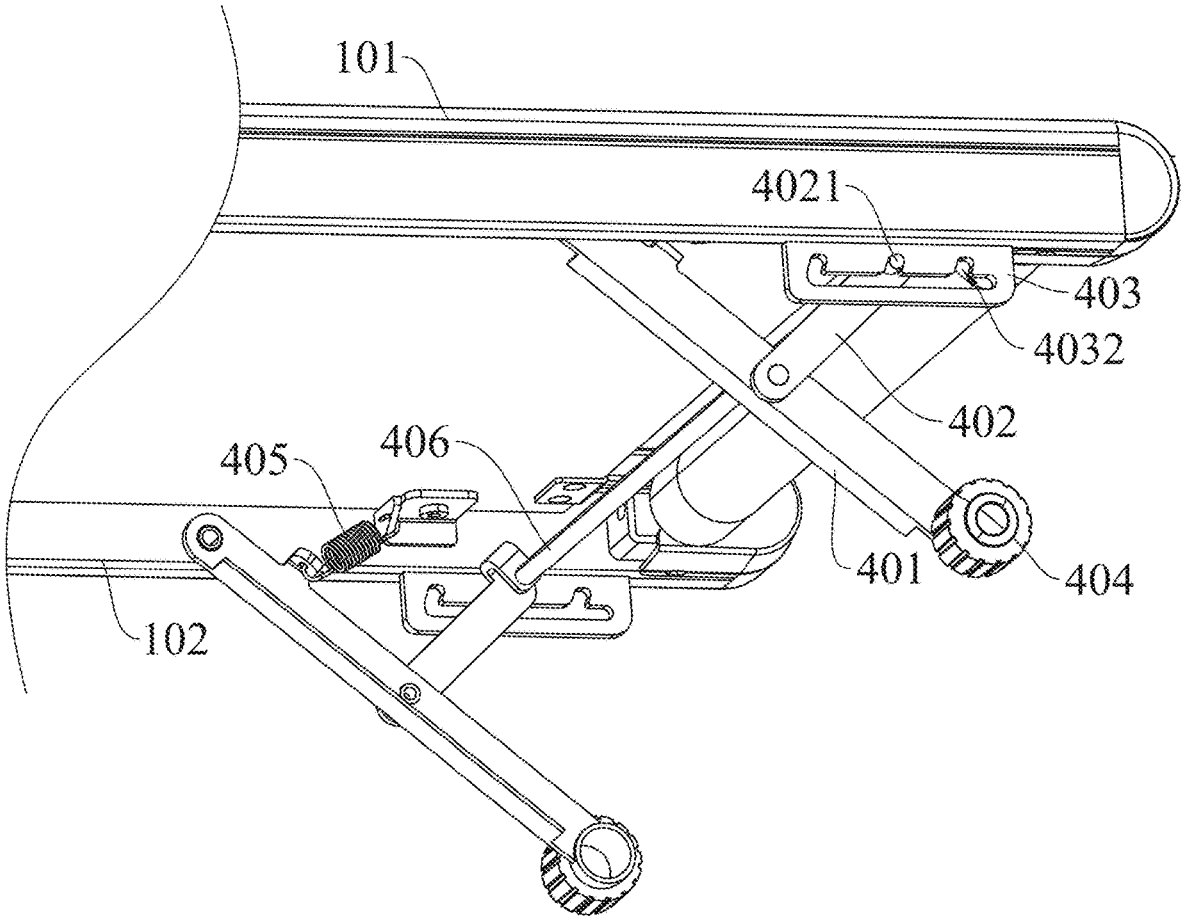
FIG. 8 is a perspective view of a second support structure being disposed below a frame according to some embodiments of the present disclosure.

As shown in FIG. 1 and FIG. 8, taking the first border 101 as an example, in some embodiments, the second support structure 40 is disposed on a side of the first border 101 facing the ground, and the second support structure 40 includes a second leg 401, a support rod 402 and a positioning plate 403.

As shown in FIG. 8, a first end of the second leg 401 is rotatably connected to the first border 101, and a second end of the second leg 401 may be selectively rotated toward or away from the ground.

Figure 9:
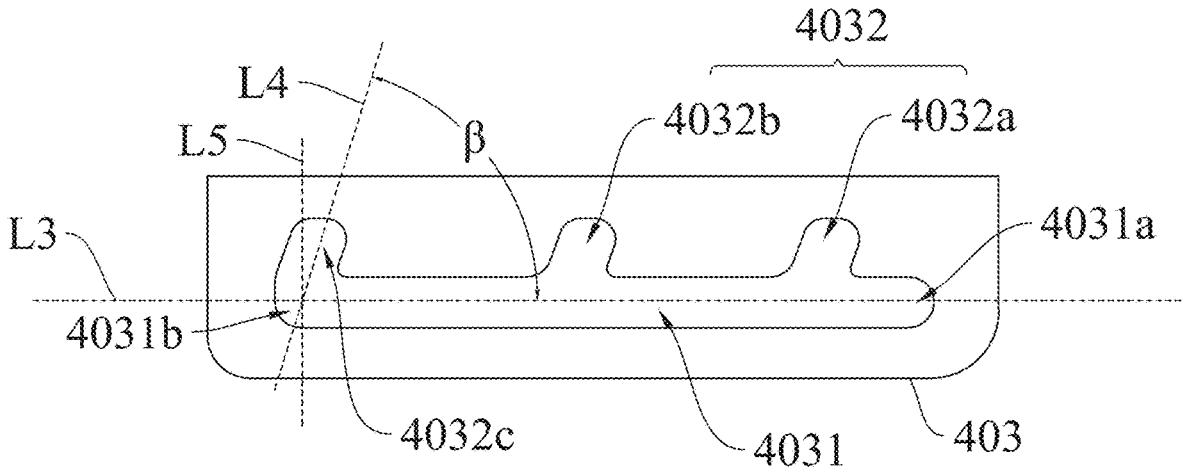
FIG. 9 is a perspective view of a positioning plate according to some embodiments of the present disclosure.

As shown in FIG. 8 and FIG. 9, a longitudinal direction of the positioning plate 403 is the same as a longitudinal direction of the first border 101. The positioning plate 403 is secured to the first border 101, and a side of the positioning plate 403 is parallel to a rotation surface of the second leg 401. In some embodiments, the rotation surface of the second leg 401 and the side of the positioning plate 403 are both perpendicular to the side of the first border 101 facing the ground. The side of the positioning plate 403 defines a slide groove 4031, and a longitudinal direction of the slide groove 4031 is the same as the longitudinal direction of the first border 101. The slide groove 4031 has a head end 4031*a* facing the second end of the frame 10 and a tail end 4031*b* opposite to the head end 4031*a*. One side of the slide 4031 facing the first border 101 defines at least one positioning notch 4032. In some embodiments, as shown in FIG. 9, three positioning notches 4032, namely, the first notch 4032*a*, the second notch 4032*b* and the third notch 4032*c*, are formed along the head end 4031*a* of the slide 4031 to the tail end 4031*b*. The first notch 4032*a* is proximal to the head end 4031*a* of the slide 4031, and there is a distance between the head end 4031*a* and the first notch 4032*a*.

In some embodiments, as shown in FIG. 9, L3 is an auxiliary line in the longitudinal direction of the slide 4031, L4 is an auxiliary line in an extension direction of the third notch 4032*c*, and an auxiliary line L5 is perpendicular to the auxiliary line L3. The auxiliary line L4 forms an acute angle β with respect to the auxiliary line L3. The purpose is that when the second support structure 40 provides support for the treadmill, a force direction of the positioning block 4021 on the positioning notch 4032 is away from the second leg 401. Therefore, the positioning notch 4032 is recessed toward the first border 101 and away from the second leg 401. When the second support structure 40 is in the supporting state, the movement of the positioning block 4021 in the positioning notch 4032 is further restricted, stabilizing the engagement between the positioning block 4021 and the positioning notch 4032.

Figure 10:
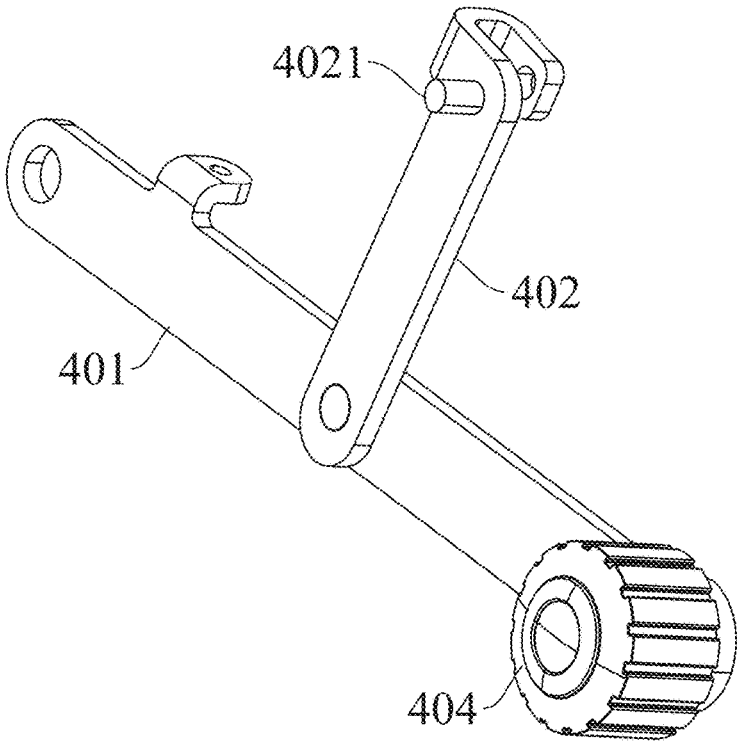
FIG. 10 is a perspective view of a second leg and a support rod and in an associated state according to some embodiments of the present disclosure.

As shown in FIG. 8 to FIG. 10, a first end of the support rod 402 is rotatably connected to the second leg 401. In some embodiments, a connection point between the support rod 402 and the second leg 401 is located in a middle of the longitudinal direction of the second leg 401. The second end of the support rod 402 is provided with a positioning block 4021 protruding outward. The positioning block 4021 may slide along the longitudinal direction of the slide groove 4031, and may selectively slide into and engage with one of the positioning notches 4032. When the positioning block 4021 of the support rod 402 slides in the slide groove 4031, the support rod 402 drives the second leg 401 to selectively rotate to support the second end of the frame 10, and locks the rotation range of the second leg 401 after the positioning block 4021 is embedded in the positioning notch 4032, thereby fixing the height of the second end of the frame 10.

In some embodiments, as shown in FIG. 8, the second support structure 40 is further provided with a tension spring 405. One end of the tension spring 405 acts on the second leg 401, and a second end of the tension spring 405 is located on a side of the first border 101 facing the positioning plate 403 and acts on the first border 101. The tension spring 405 may provide a driving force for the second leg 401 to rotate to the folded state. When the second leg 401 is in the supporting state, the positioning block 4021 may be restricted in the positioning notch 4032 by the above-mentioned tension. When the second leg 401 is subjected to other external forces, the positioning block 4021 may still be detached from the positioning notch 4032, and may be selectively switched to other positioning notches 4032. In addition, the tension provided by the tension spring 405 may also assist the second leg 401 to quickly convert from the supporting state to the folded state, and keep the second leg 401 in the folded state. In some embodiments, a coil spring or a ground spring is provided at a transition connection between the second leg 401 and the first border 101, which may replace the tension spring 405 and achieve the above-mentioned technical effect of the tension spring 405. No specific restrictions are made here.

In some embodiments, as shown in FIG. 8, a connecting rod 406 is provided between the two second support structures 40. A first end of the connecting rod 406 is connected to a side of one support rod 402 away from the positioning plate 403, and a second end of the connecting rod 406 is connected to a side of the other support rod 402 away from the positioning plate 403. The connecting rod 406 may keep the two second support structures 40 synchronized when adjusting the position, reducing the difficulty of operation. Moreover, the two second support structures 40 may also restrict each other, improving the stability of the treadmill.

In some embodiments, as shown in FIG. 8, the second end of the second leg 401 is provided with a wheel 404 to facilitate the movement of the treadmill.

As shown in FIG. 11 to FIG. 15, the second support structure 40 is in different states.

Figure 11:
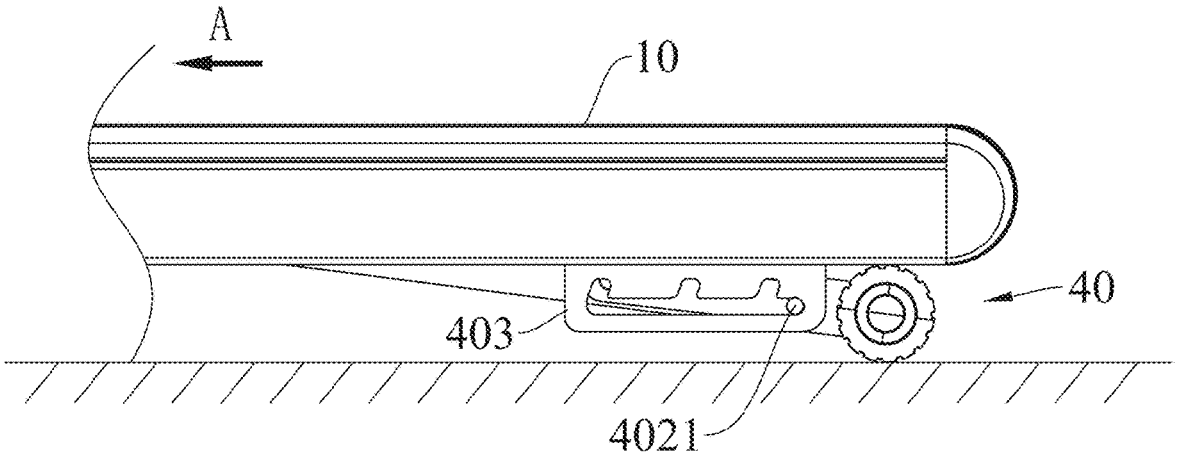
FIGS. 11 to 14 are perspective views of a second support structure in the first to fourth positions according to some embodiments of the present disclosure.

The positioning block 4021 in FIG. 11 is engaged with the head end 4031*a* of the slide slot 4031, and the second support structure 40 is in a lowest state, which is defined as a first position of the second support structure 40.

Figure 12:
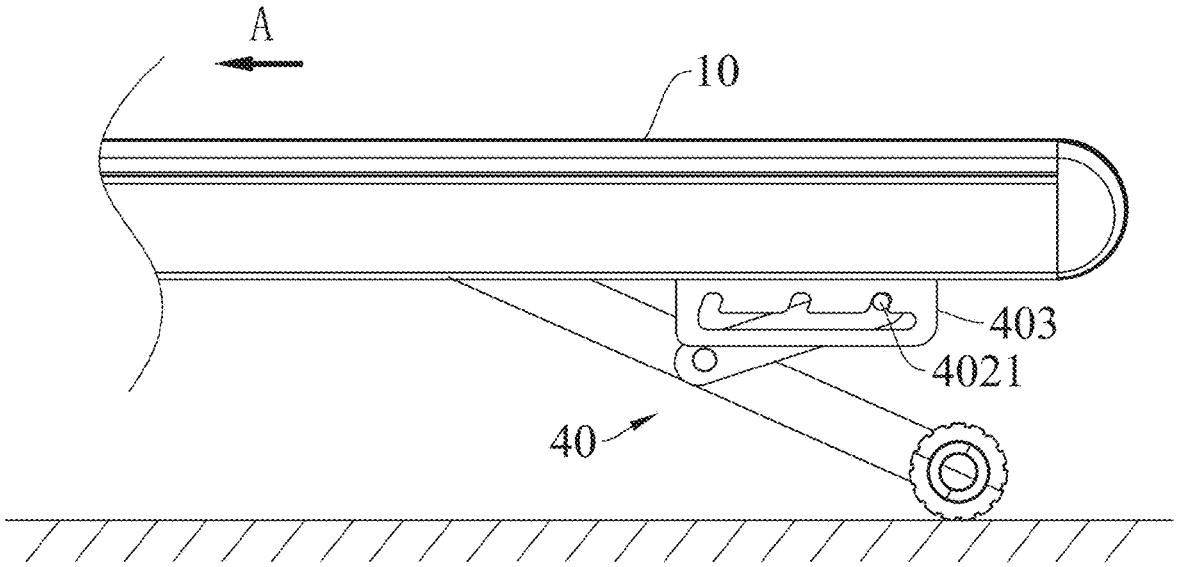

As shown in FIG. 12, the positioning block 4021 is engaged with the first notch 4032*a* of the positioning plate 403. Compared with the first position of the second support structure 40, the second end of the frame 10 is raised in height, and this state is defined as a second position of the second support structure 40.

Figure 13:
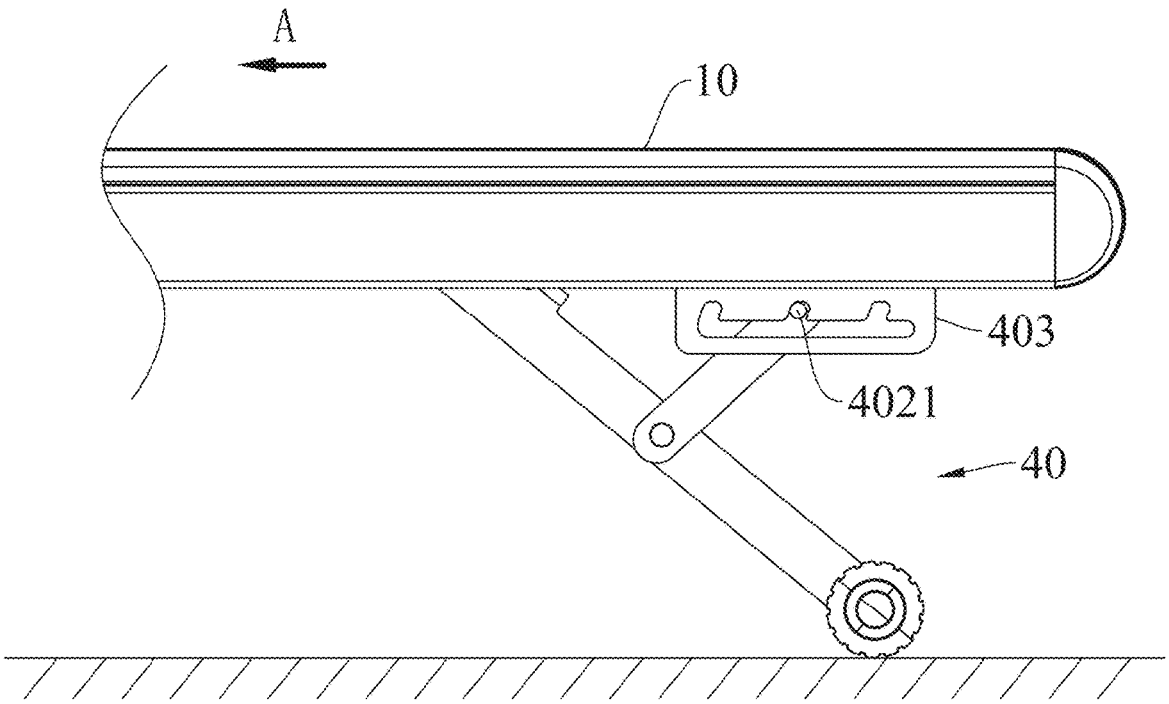
Figure 14:
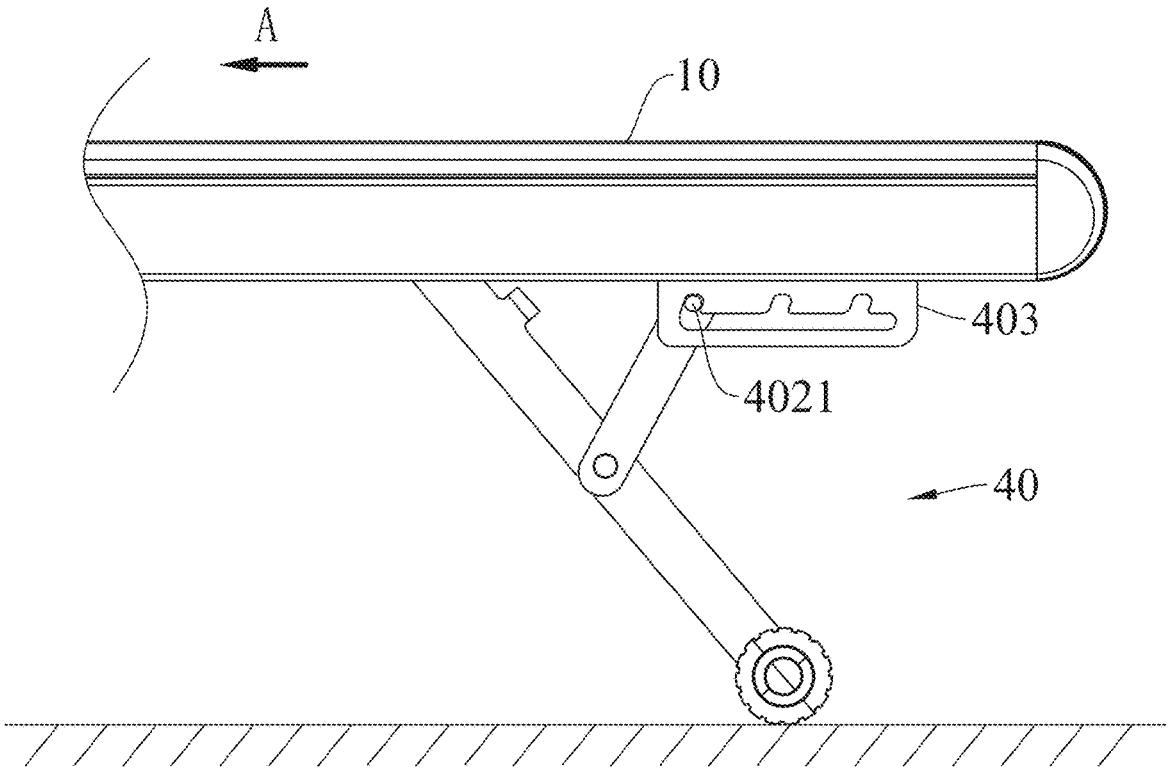

As shown in FIG. 13, the positioning block 4021 is engaged with the second notch 4032*b* of the positioning plate 403, and the positioning block 4021 in FIG. 14 is engaged with the third notch 4032*c* of the positioning plate 403. Compared with the first and second positions of the second support structure 40, the second end of the frame 10 is further raised in height, which may be defined as a third position and a fourth position of the second support structure 40 respectively.

Figure 15:
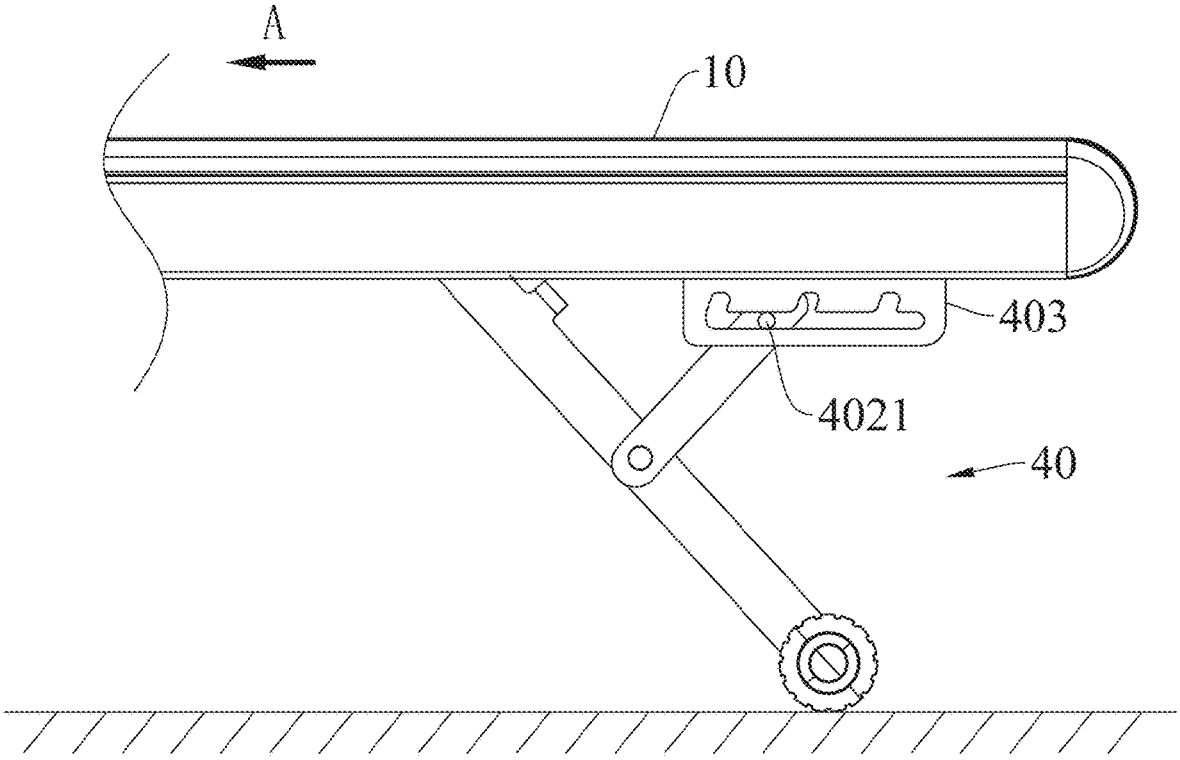
FIG. 15 is a perspective view of a positioning block moving in a slide groove of a positioning plate according to some embodiments of the present disclosure.

As shown in FIG. 15, the positioning block 4021 is located in the slide groove 4031 between the second notch 4032*b* and the third notch 4032*c* of the positioning plate 403. This state may be understood as the second support structure 40 shifting from the fourth position to other positions, or shifting from other positions to the fourth position. The shift of other positions is similar, and will not be repeated here.

Figure 16:
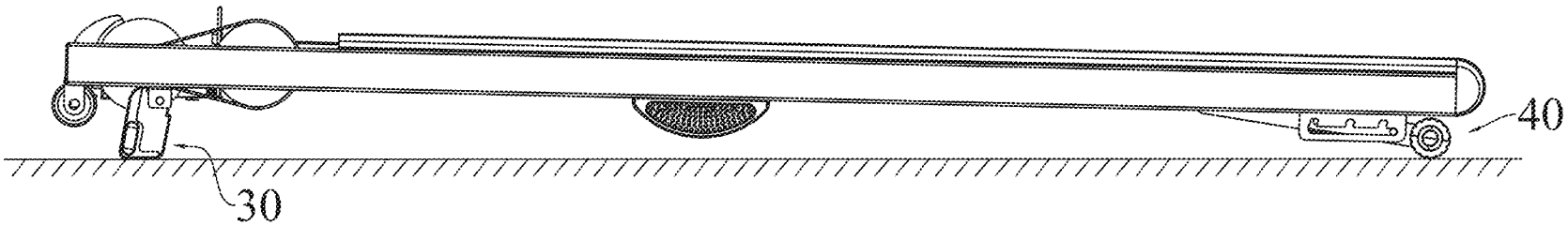
FIGS. 16 and 17 are perspective views of a treadmill with two slopes according to some embodiments of the present disclosure.
Figure 17:
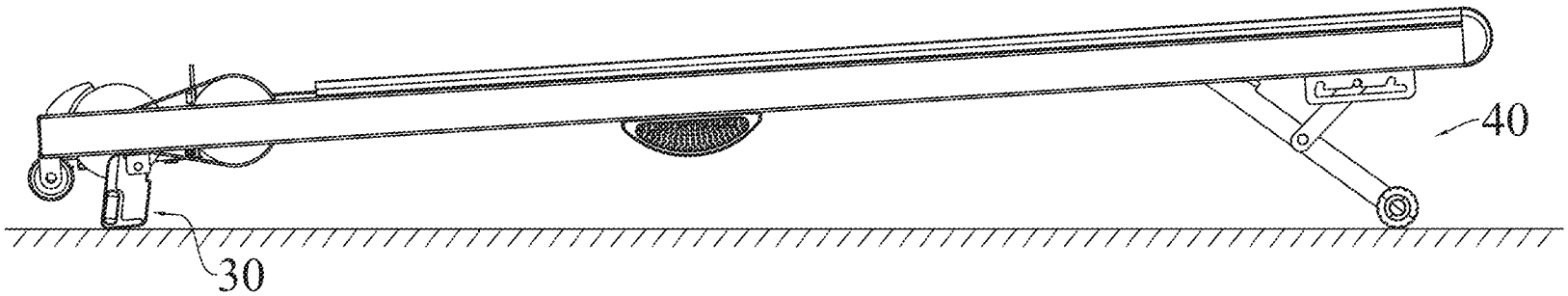
Figure 18:
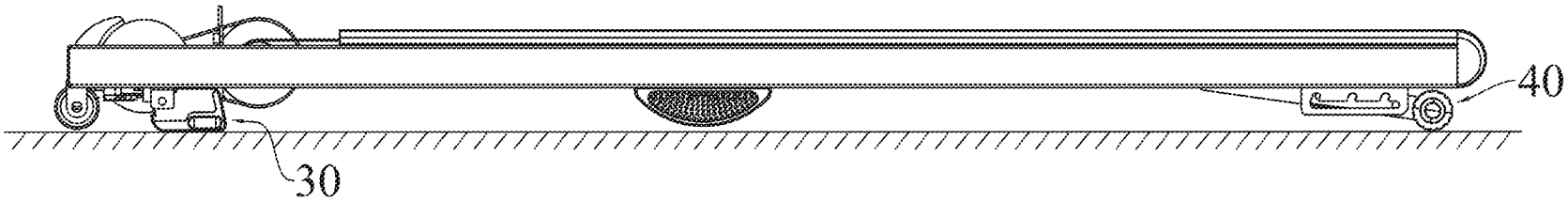
FIG. 18 is a perspective view of a treadmill in a horizontal state according to some embodiments of the present disclosure.

The treadmill of the present disclosure may adjust a variety of slopes through the cooperation of the first support structures 30 and the second support structures 40. As shown in FIG. 16, the first support structure 30 is in the supporting state, and the second support structure 40 is in the first position (the second end of the frame 10 is in the lowest position), and the treadmill is in the positive slope. As shown in FIG. 17, the first support structure 30 is in the supporting state, and the second support structure 40 is in the third position (when the positioning block 4021 is located in the second notch 4032*b* of the positioning plate 403), and the treadmill is in the negative slope. In addition, as shown in FIG. 18, when the first support structure 30 and the second support structure 40 are both in the folded state, the treadmill is in a horizontal state. The horizontal state means that the treadmill is parallel to the ground, not specifically a plane perpendicular to the direction of gravity.

In some embodiments, a crossbeam is provided at the first end of the frame 10, and two ends of the crossbeam are secured to the first border 101 and the second border 102, respectively. The two first support structures 30 in the above embodiments may also be installed on the crossbeam, and the first support structure 30 is as close to the first border 101 as possible, and the other first support structure 30 is as close to the second border 102 as possible, allowing a sufficient distance to be maintained between the two first support structures 30, thereby improving the stability of the treadmill.

The ground in the above embodiments is only a general reference to the support surface of the treadmill, not just referring to the earth.

Compared with the related art, the implementation scheme of the present disclosure adopts manual adjustment. Compared with the motor-driven lifting mechanism, the manufacturing cost and maintenance cost of the present disclosure are lower. Secondly, the treadmill frame of the present disclosure is provided with support structures at both ends, and the slope of the treadmill can be adjusted to a positive slope, a negative slope or a horizontal slope as needed. Thirdly, for the negative slope, the present disclosure has a multi-level adjustment function, and the angle of the negative slope can be adjusted as needed.

The above description only illustrates some embodiments of the present disclosure, and does not limit the protection scope of the present disclosure. All equivalent structural changes made by using the contents in the specification and drawings under the concept of the present disclosure, or directly/indirectly used in other related technical fields are included in the protection scope of the present disclosure.

What is claimed is:

1. A manually adjustable lifting mechanism comprising:

a frame having a first end and a second end opposite to each other in a longitudinal direction of the frame;

two first supporting structures disposed at the first end of the frame, each of the two first supporting structures disposed on the frame along the longitudinal direction of the frame, each of the two first supporting structures comprising a first leg having a first end rotatably connected to the frame, and the first leg selectively rotated between a supporting state and a folding state; and two second supporting structures disposed at the second end of the frame, each of the two second supporting structures disposed on the frame along the longitudinal direction of the frame, each of the two second supporting structures comprising:

a second leg, a first end of the second leg being rotatably connected to the frame;

a positioning plate secured to the frame, and a side of the positioning plate being parallel to a rotation surface of the second leg; the side of the positioning plate defining a slide groove, and at least one side of the slide groove along a longitudinal direction of the slide groove defining at least one positioning notch; and a support rod, a first end of the support rod being rotatably connected to the first end of the second leg, a second end of the support rod being provided with a positioning block, and the positioning block configured to slide in the slide groove;

wherein the second leg is configured to selectively rotate toward a support surface and drive the positioning block to slide in the slide groove, and the positioning block is configured to selectively slide into the at least one positioning notch to lock the second leg; and wherein each of the two second support structures further comprise a spring, one end of the spring is connected to the frame and another end of the spring is connected to the second leg, and the spring is configured to provide a driving force for the second leg to rotate to the folded state.

2. The lifting mechanism according to claim 1, wherein each of the two first support structures further comprise a support seat, the support seat is secured to the frame, the first end of the first leg is rotatably connected to the support seat, and the first leg is configured to be selectively rotated toward the support surface.

3. The lifting mechanism according to claim 2, wherein each of the two first support structures is disposed on a side of the frame facing the support surface;

a first side surface of the first leg of each of the two first supporting structures abuts against the frame in response to the first leg of each of the two first supporting structures being in the supporting state; and a third side surface of the first leg of each of the two first supporting structures abuts against the frame in response to the first leg of each of the two first supporting structures being in the folded state.

4. The lifting mechanism according to claim 3, wherein the support seat of each of the two first supporting structures comprises a seat bottom and a hinge, the seat bottom is secured to the frame, the hinge is secured to the seat bottom, and the first leg of each of the two first supporting structures is rotatably connected to the hinge;

the first side surface of the first leg of each of the two first supporting structures defines a first groove, and the first groove receives at least a portion of the seat bottom in response to the first leg of each of the two first supporting structures being in the supporting state; and a second side surface of the first leg of each of the two first supporting structures defines a second groove, and the second groove receives at least a portion of the seat bottom in response to the first leg of each of the two first supporting structures being in the folded state.

5. The lifting mechanism according to claim 1, wherein the slide groove of each of the two second supporting structures has a first end away from the second leg of the corresponding one of the two second supporting structures and a second end proximal to the second leg of the corresponding one of the two second supporting structures, and the first end of the slide groove of each of the two second supporting structures defines the at least one positioning notch.

6. The lifting mechanism according to claim 1, wherein the longitudinal direction of the slide groove of each of the two second supporting structures is parallel to the longitudinal direction of the frame, and the at least one positioning notch of each of the two second supporting structures is disposed on the at least one side of the slide groove of each of the two second supporting structures facing the frame; or/and an extension direction of the at least one positioning notch of each of the two second supporting structures forms an acute angle with respect to the longitudinal direction of the slide groove of each of the two second supporting structures.

7. The lifting mechanism according to claim 1, wherein a connecting rod is provided between the two second support structures, a first end of the connecting rod is connected to the support rod of one of the two second support structures, a second end of the connecting rod is connected to the support rod of another of the two second support structures, and the two second support structures are kept synchronized by the connecting rod; or/and a second end of the second leg of each of the two second supporting structures is provided with a rotatable wheel.

8. The lifting mechanism according to claim 1, wherein the frame comprises at least two borders each disposed on one side of the frame along the longitudinal direction of the frame; each of the two first support structures and each of the two second support structures are mounted on one of the two borders; or/and an engagement between the two first support structures and the two second support structures are selectively adjusted to a positive slope, a negative slope or a horizontal state.

9. The lifting mechanism according to claim 1, wherein a side of the first leg of each of the two first supporting structures defines a clamping groove.

10. A manually adjustable lifting mechanism, comprising:

a frame having a first end and a second end opposite to each other; and two first supporting structures disposed at the first end of the frame, each of the two first supporting structures comprising a support seat and a first leg, the support seat of each of the two first supporting structures being secured to the frame, the first leg of each of the two first supporting structures having a first end rotatably connected to the support seat of a corresponding one of the two first supporting structures;

wherein the first leg of each of the two first supporting structures is configured to rotate between a supporting state and a folding state;

a first side surface of the first leg of each of the two first supporting structures abuts against the frame in response to the first leg of each of the two first supporting structures being in the supporting state; and a third side surface of the first leg of each of the two first supporting structures abuts against the frame in response to the first leg of each of the two first supporting structures being in the folded state;

wherein the manually adjustable lifting mechanism further comprises:

two second supporting structures disposed at the second end of the frame, each of the two second supporting structures comprising:

a second leg having a first end rotatably connected to the frame;

a positioning plate secured to the frame and defining at least one positioning notch; and a support rod, a first end of the support rod being rotatably connected to the first end of the second leg of a corresponding one of the two second supporting structures, a second end of the support rod being provided with a positioning block;

wherein the second leg of each of the two second supporting structures is configured to rotate toward a support surface, and the positioning block is configured to engage with the at least one positioning notch to lock the second leg.

* * * * *